US005467601A

United States Patent [19]

Paolino et al.

[11] Patent Number: 5,467,601

[45] Date of Patent: Nov. 21, 1995

[54] AIR BOILING CRYOGENIC RECTIFICATION SYSTEM WITH LOWER POWER REQUIREMENTS

[75] Inventors: Gerald A. Paolino, Lancaster; Raymond F. Drnevich, Clarence Center; Neil M. Prosser, East Amherst, all of N.Y.

[73] Assignee: Praxair Technology, Inc., Danbury, Conn.

[21] Appl. No.: 240,423

[22] Filed: May 10, 1994

[51] Int. Cl.[6] ..... F25J 3/02

[52] U.S. Cl. ..... 62/38; 62/25; 62/41

[58] Field of Search ..... 62/25, 38, 41, 62/40

[56] References Cited

U.S. PATENT DOCUMENTS

| | | | |
|---|---|---|---|
| 2,850,880 | 9/1958 | Jakob | 62/29 |
| 3,327,489 | 6/1967 | Gaumer, Jr. | 62/29 |
| 4,410,343 | 10/1983 | Ziemer | 62/29 |
| 4,448,595 | 5/1984 | Cheung | 62/31 |
| 4,702,757 | 10/1987 | Kleinberg | 62/24 |
| 4,704,148 | 11/1987 | Kleinberg | 62/24 |
| 4,936,099 | 6/1990 | Woodward et al. | 62/24 |
| 5,074,898 | 12/1991 | Cheung | 62/38 |
| 5,144,808 | 9/1992 | Ha | 62/41 X |
| 5,157,926 | 10/1992 | Guilleminot | 62/24 |
| 5,251,451 | 10/1993 | Xu et al. | 62/41 X |
| 5,315,833 | 5/1994 | Ha et al. | 62/38 |
| 5,337,570 | 8/1994 | Prosser | 62/38 X |
| 5,349,824 | 9/1994 | Ha et al. | 62/38 X |

*Primary Examiner*—Christopher Kilner
*Attorney, Agent, or Firm*—Stanley Ktorides

[57] ABSTRACT

An air boiling cryogenic rectification system wherein additional feed air streams are used for vaporizing pressurized liquid oxygen in a once through main heat exchanger and, by turboexpansion, for the generation of refrigeration prior to being passed into the higher pressure column.

9 Claims, 4 Drawing Sheets

AIR BOILING CRYOGENIC RECTIFICATION SYSTEM WITH LOWER POWER REQUIREMENTS

TECHNICAL FIELD

This invention relates generally to cryogenic rectification using air boiling and is particularly advantageous for the production of elevated pressure oxygen having an oxygen concentration within the range of from 70 to 98 mole percent.

BACKGROUND ART

The cryogenic rectification of air to produce oxygen and nitrogen is a well established industrial process. Typically the feed air is separated in a double column system wherein nitrogen shelf or top vapor from a higher pressure column is used to reboil oxygen bottom liquid in a lower pressure column.

The demand for lower purity oxygen is increasing in applications such as glassmaking, steelmaking and energy production. Less vapor boilup in the stripping sections of the lower pressure column, and less liquid reflux in the enriching sections of the lower pressure column are necessary for the production of lower purity oxygen, which has an oxygen purity of less than 98.5 mole percent, than are typically generated by the operation of a double column.

Accordingly, lower purity oxygen is generally produced in large quantities by a cryogenic rectification system wherein feed air at the pressure of the higher pressure column is used to reboil the liquid bottoms of the lower pressure column and is then passed into the higher pressure column. The use of air instead of nitrogen to vaporize the lower pressure column bottoms reduces the air feed pressure requirements, and enables the generation of only the necessary boil-up in the stripping sections of the lower pressure column either by feeding the appropriate portion of the air to the lower pressure column reboiler or by partially condensing a larger portion of the total feed air.

While the conventional air boiling cryogenic rectification system would be effective for the production of lower purity oxygen, its ability to generate liquid nitrogen reflux for supply to the top of the lower pressure column is limited. This results from the lower component relative volatilities at the operating pressure of the higher pressure column which is similar to that of the main air feed and because of the large fraction of liquid air produced in the process compared to a conventional double column process. More power is consumed because oxygen recovery is reduced as a result of the reduced capability to generate liquid nitrogen reflux.

Accordingly, it is an object of this invention to provide a cryogenic rectification system for producing lower purity oxygen wherein the liquid bottoms of a lower pressure column are reboiled by indirect heat exchange with feed air and which operates with reduced power requirements over that of conventional air boiling systems.

Often it is desired to recover the product oxygen gas at an elevated pressure. Generally this is carried out by compressing the product gas to a higher pressure by passage through a compressor. Such a system is effective but is quite costly. Moreover, air boiling cryogenic rectification systems have heretofore been most useful for the production of lower pressure oxygen.

Accordingly, it is another object of this invention to provide an air boiling cryogenic rectification system which can effectively produce elevated pressure oxygen gas without the need for oxygen gas compression thus further reducing power requirements.

SUMMARY OF THE INVENTION

The above and other objects which will become apparent to one skilled in the art upon a reading of this disclosure are attained by the present invention, one aspect of which is:

In a cryogenic air separation process employing a higher pressure column and a lower pressure column wherein feed air is employed to boil the bottom liquid of the lower pressure column and is thereafter passed into the higher pressure column and wherein liquid oxygen is produced in the lower pressure column, the improvement comprising:

(A) turboexpanding a second portion of feed air to generate refrigeration and passing turboexpanded second feed air into the higher pressure column;

(B) withdrawing liquid oxygen from the lower pressure column and increasing the pressure of the withdrawn liquid oxygen;

(C) vaporizing the pressurized liquid oxygen by indirect heat exchange with a third feed air portion which is at a pressure higher than that of the feed air employed to boil the bottom liquid of the lower pressure column, and also with feed air which is subsequently employed to boil the bottom liquid of the lower pressure column, resulting in the production of oxygen gas;

(D) recovering resulting oxygen gas as elevated pressure oxygen gas product.

Another aspect of the invention is:

In a cryogenic rectification apparatus having a first column, a second column with a bottom reboiler and means for passing a feed stream to the bottom reboiler and from the bottom reboiler into the first column, the improvement comprising:

(A) a turboexpander, means for passing a second feed stream to the turboexpander and from the turboexpander into the first column;

(B) means for withdrawing liquid from the second column and means for increasing the pressure of the liquid withdrawn from the second column to produce elevated pressure liquid;

(C) a main heat exchanger, means for passing a third feed stream to the main heat exchanger, and means for passing said elevated pressure liquid to the main heat exchanger;

(D) means for passing feed through the main heat exchanger prior to passing it to the bottom reboiler; and (E) means for recovering gas product from the main heat exchanger.

As used herein the term "liquid oxygen" means a liquid having an oxygen concentration within the range of from 70 to 98 mole percent.

As used herein, the term "feed air" means a mixture comprising primarily nitrogen and oxygen, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "top condenser" means a heat exchange device which generates column downflow liquid from column top vapor.

As used herein, the term "bottom reboiler" means a heat exchange device which generates column upflow vapor from column bottom liquid.

DETAILED DESCRIPTION

The invention will be described in detail with reference to the Drawings.

Figure 1:
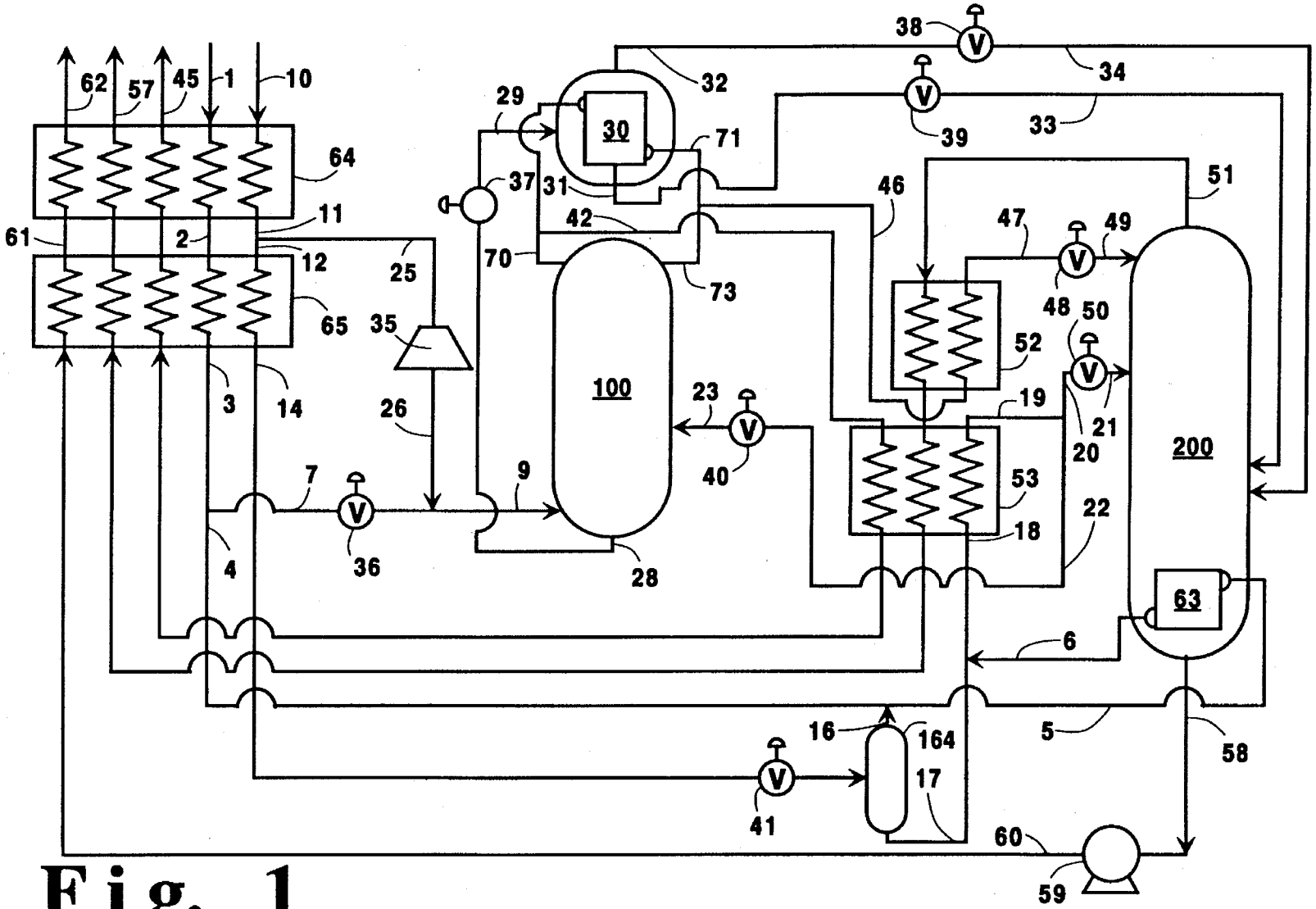
FIG. 1 is a schematic representation of one preferred embodiment of the invention.

Referring now to FIG. 1, feed air 1, at a pressure generally within the range of from 40 to 65 pounds per square inch absolute (psia), is cooled by indirect heat exchange with return streams in main heat exchanger section 64 and then resulting feed air stream 2 is further cooled by passage through main heat exchanger section 65. The main heat exchanger may be in one section or, as illustrated in FIG. 1, may be in more than one section. Resulting feed air stream 3 is divided into streams 4 and 7. Stream 4 is combined with stream 16 from phase separator 64 and resulting stream 5 is passed into reboiler 63 wherein it is at least partially condensed while serving to boil the bottom liquid of lower pressure column 200 which is operating at a pressure generally within the range of from 18 to 25 psia. In the embodiment illustrated in FIG. 1, feed air stream 5 is totally condensed in reboiler 63. Resulting feed air is passed in stream 6 from bottom reboiler 63 and is combined with stream 17 from phase separator 64 to form combined stream 18. At least a portion of stream 18 is passed into higher pressure column 100 which is operating at a pressure greater than that of lower pressure column 200 and generally within the range of from 30 to 60 psia. If desired, the feed air from the bottom reboiler of the lower pressure column may be passed directly into the higher pressure column.

Another feed air stream 10, at a pressure greater than that of stream 1 and generally at a pressure within the range of from 80 to 1400 psia, is cooled by passage through main heat exchanger section 64. Resulting feed air stream 11 is divided into stream 25 and stream 12. Stream 25 comprises a second portion of the feed air which is turboexpanded by passage through turboexpander 35 to generate refrigeration. Resulting feed air stream 26 is combined with stream 7 which has been passed through valve 36 to form stream 9 which is passed into higher pressure column 100.

Stream 12 comprises a third portion of the feed air and is at a pressure which is higher than the pressure of the feed air used to boil the bottoms of lower pressure column 200. Stream 12 is at least partially condensed by passage through main heat exchanger section 65 by indirect heat exchange with vaporizing pressurized liquid oxygen. The resulting liquid feed air is passed in line 14 through valve 41 into phase separator 64. As discussed previously vapor from phase separator 64 is passed in line 16 into feed stream 4 to form combined stream 5 which is passed to bottom reboiler 63. Liquid feed air 17 is then combined with stream 6 to form feed air stream 18 which is subcooled by passage through heat exchanger 53 to form stream 19.

At least a portion 22 of liquid feed air 19 is throttled to the pressure of higher pressure column 100 by passage through valve 40 and the resulting feed air stream 23 is passed into higher pressure column 100. If desired, a portion 20 of liquid feed air 19 is throttled to the pressure of lower pressure column 200 by passage through valve 50 and the resulting feed air portion 21 is passed into lower pressure column 200.

Within higher pressure column 100 the feeds into that column are separated by cryogenic rectification into nitrogen-enriched vapor and oxygen-enriched liquid. Nitrogen-enriched vapor 70 is passed into top condenser 30 wherein it is condensed. Resulting liquid 71 is divided into reflux streams 46 and 73. Reflux stream 73 is passed as reflux into higher pressure column 100. Reflux stream 46 is subcooled by passage through heat exchanger 52 and resulting stream 47 is throttled to the pressure of lower pressure column 200 by passage through valve 48 and passed as reflux stream 49 into lower pressure column 200. If desired, a portion 42 of the nitrogen-enriched vapor may be warmed by passage through heat exchanger 53 and main heat exchanger sections 65 and 64 and recovered as high pressure nitrogen gas product 45 having a purity of up to about 99.9 mole percent.

Oxygen-enriched liquid is withdrawn from column 100 in stream 28 and is throttled by passage through valve 37. Resulting stream 29 is passed into top condenser 30 wherein it is partially vaporized by indirect heat exchange with condensing nitrogen-enriched vapor. Resulting oxygen-enriched vapor and remaining oxygen-enriched liquid are passed in streams 32 and 31 respectively through valves 38 and 39 respectively wherein they are throttled to the pressure of lower pressure column 200. Respective resulting vapor stream 34 and liquid stream 33 are then passed into lower pressure column 200.

The various feeds into lower pressure column 200 are separated by cryogenic rectification within column 200 to produce nitrogen vapor and liquid oxygen. Nitrogen vapor is withdrawn from column 200 as stream 51 and warmed by passage through heat exchangers 52 and 53 and main heat exchanger sections 65 and 64, and, if desired, recovered as lower pressure nitrogen gas product 57 having a nitrogen purity of up to about 99.5 mole percent.

Liquid oxygen is withdrawn from lower pressure column 200 in stream 58 and is increased in pressure such as by passage through liquid pump 59. Resulting pressurized liquid oxygen 60 is then vaporized by indirect heat exchange in main heat exchanger section 65 with elevated pressure feed air, e.g., stream 12, and lower pressure feed air, e.g. stream 3, which is passed, at least in part, to bottom reboiler 63. Resulting oxygen gas produced by this heat exchange is passed as stream 61 through main heat exchanger section 64 wherein it is warmed, and is then recovered as elevated pressure oxygen gas product 62 generally having a pressure within the range of from 40 to 1400 psia and an oxygen concentration within the range of from 70 to 98 mole percent.

Figure 2:
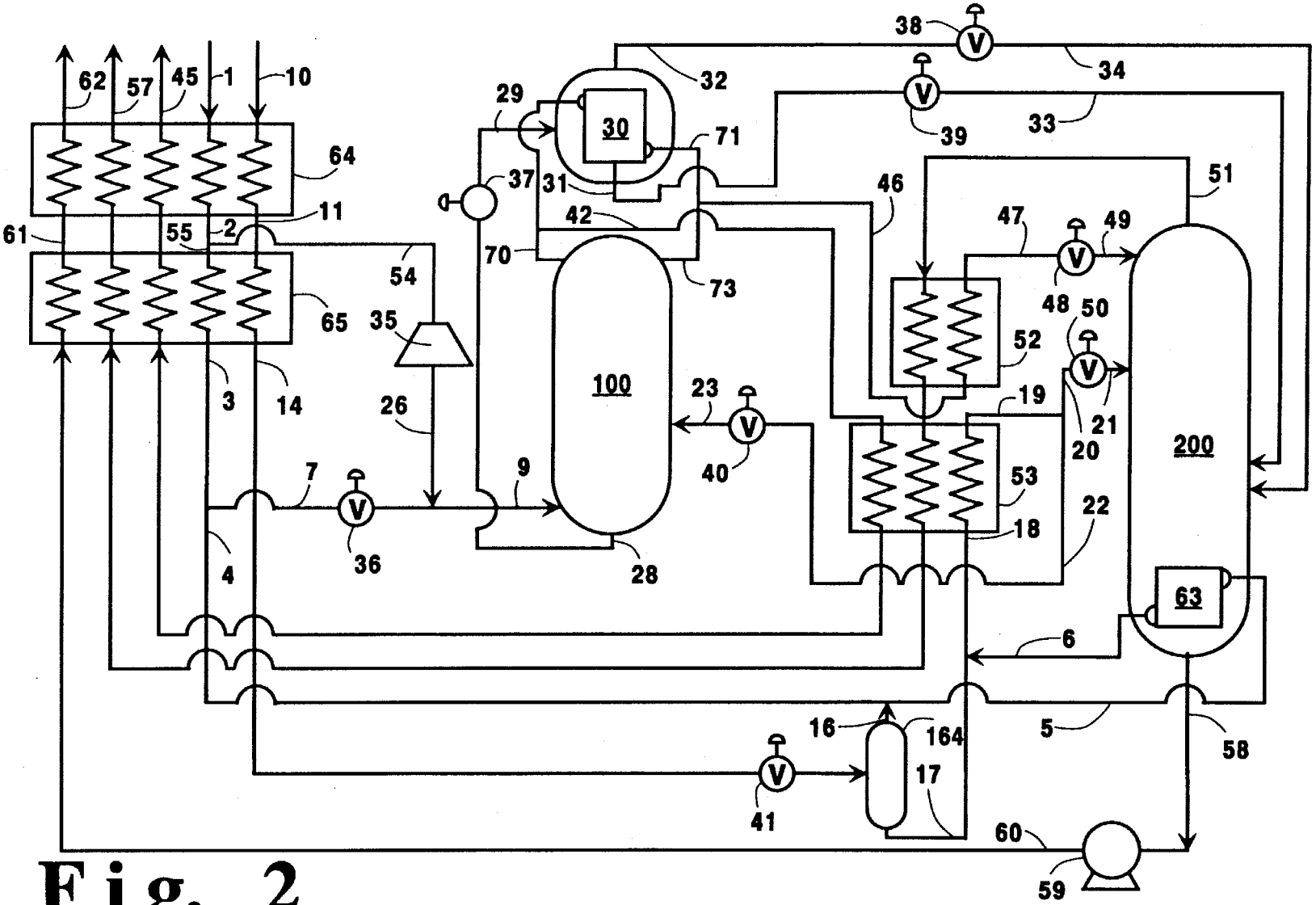
FIG. 2 is a schematic representation of another preferred embodiment of the invention.

FIG. 2 illustrates another embodiment of the invention. The embodiment illustrated in FIG. 2 is particularly useful for the production of oxygen having a purity of 90 to 98 mole percent. The numerals in FIG. 2 correspond to those of FIG. 1 for the common elements and these common elements will not be described again in detail. The embodiment illustrated in FIG. 2 differs from that illustrated in FIG. 1 in that the second portion of the feed air, in this case stream 54, which is subsequently turboexpanded to generate refrigeration, is taken from lower pressure feed air stream 2 rather than from elevated feed air stream 11. Remaining lower pressure feed air stream 55 is then passed through main heat exchanger section 65 to carry out with stream 11 the vaporization of the pressurized liquid oxygen.

Figure 3:
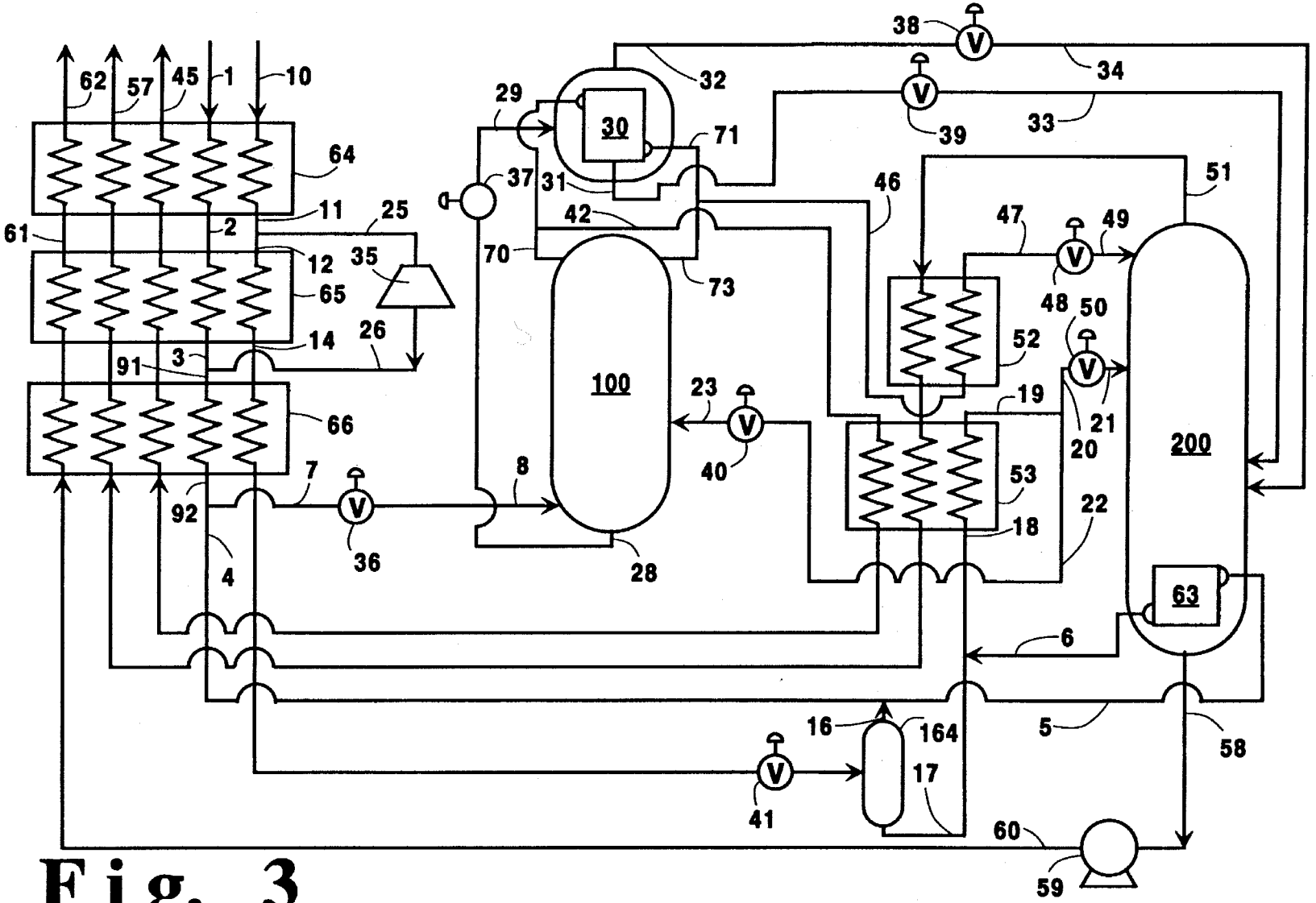
FIG. 3 is a schematic representation of another preferred embodiment of the invention.

FIG. 3 illustrates another embodiment of the invention. The numerals in FIG. 3 correspond to those of FIG. 1 for the common elements and these common elements will not be described again in detail. The embodiment illustrated in FIG. 3 differs from that illustrated in FIG. 1 primarily in that turboexpanded feed air 26 is not passed directly into higher pressure column 100. Rather turboexpanded stream 26 is combined with stream 3 to form feed air stream 91 which is then passed through heat exchanger 66 from which it emerges as stream 92 before being divided into streams 4 and 7. Stream 7 which contains at least some of the turboexpanded second feed air portion is ultimately passed into higher pressure column as stream 8. Stream 4 which contains at least some of the lower pressure feed air portion is ultimately passed as stream 5 through bottom reboiler 63 and then, at least in part, into higher pressure column 100. In the practice of the embodiment illustrated in FIG. 3, the higher pressure feed air stream 14, as well as pressurized liquid oxygen stream 60 and nitrogen gas streams 42 and 51 also pass through heat exchanger 66.

Figure 4:
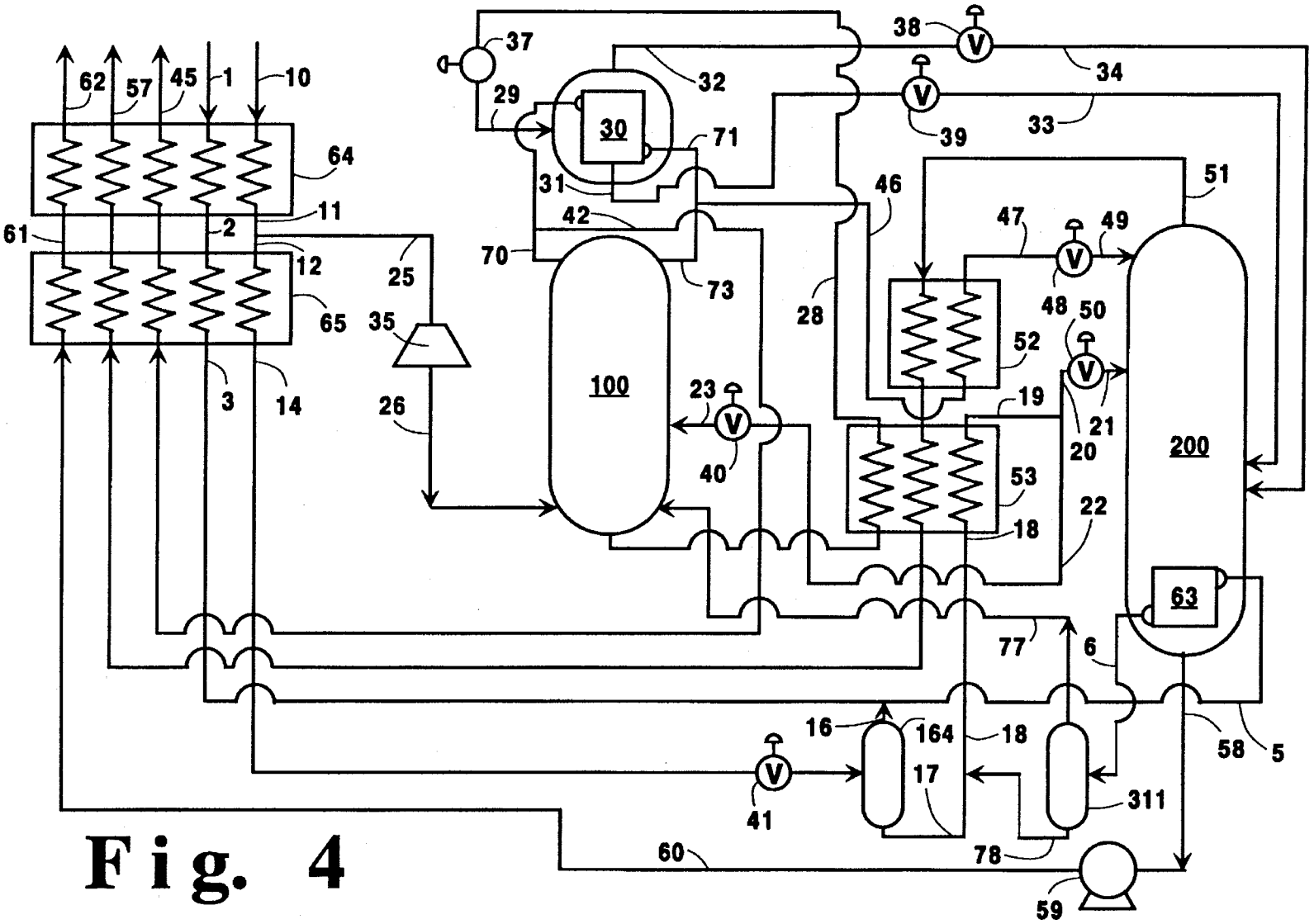
FIG. 4 is a schematic representation of another preferred embodiment of the invention wherein the feed air used to boil the bottoms of the lower pressure column is only partially condensed.

FIG. 4 illustrates another embodiment of the invention. The numerals in FIG. 4 correspond to those of FIG. 1 for the common elements and these common elements will not be described again in detail. The embodiment illustrated in FIG. 4 is one wherein the feed air is only partially condensed in reboiler 63. Such an embodiment is particularly advantageous for the production of oxygen having a purity within the range of from 70 to 90 mole percent.

Referring now to FIG. 4, this embodiment differs from those of FIGS. 1–3 in that turboexpanded stream 26 is passed directly into higher pressure column 100 without being combined with another feed air stream and a portion of stream 3 is not passed into the higher pressure column upstream of the passage into reboiler 63. Moreover, oxygen-enriched liquid stream 28 is passed through heat exchanger 53 wherein it is subcooled prior to being passed to valve 37. The feed air stream 5 is partially condensed in reboiler 63 and resulting dual phase stream 6 is passed into phase separator 311. Vapor from phase separator 311 is passed as stream 77 into higher pressure column 100 while liquid from phase separator 311 in stream 78 is combined with stream 17 and further processed as previously described.

An advantage of the invention is a lower power requirement for the compression of the high pressure air stream. Not only will this lead to a decrease in operating costs, but it may result in savings associated with the capital costs of compression equipment. The difference is the boiling of the liquid oxygen in the main heat exchanger instead of a product boiler or reboiler/condenser. In a reboiler/condenser the liquid in the vessel flows up through the reboiler as it is vaporized. Typically the vapor will carry liquid with it as it flows up through the core. At the top of the core the vapor/liquid mixture exits the core. The vapor and liquid are in equilibrium, with the liquid fraction containing a higher fraction of oxygen than the vapor. The vapor will disengage from the liquid and will exit the vessel at the desired purity. This vapor is typically warmed to ambient temperature in the main heat exchanger against the incoming air. After the vapor disengages from the liquid the liquid returns to the liquid pool at the bottom of the reboiler and mixes with the incoming liquid oxygen from the low pressure column. The result of this process is that the liquid oxygen pool around the reboiler will have a higher oxygen content than the liquid oxygen from the low pressure column. The higher oxygen content results in a higher boiling point temperature than the liquid from the low pressure column and thus, an increase in the air pressure required to boil the liquid pool.

With the practice of this invention wherein the liquid oxygen is vaporized in the main heat exchanger, the vapor and liquid do not reach the point of equilibrium because all of the liquid that flows into the heat exchanger is vaporized. There is not a recirculation of liquid as there is in a product boiler or reboiler/condenser heat exchanger. Thus, the high pressure feed air does not have to be supplied at as high a pressure, resulting in lower power requirements and potentially less expensive equipment.

Although the invention has been described in detail with reference to certain preferred embodiments, those skilled in the art will recognize that there are other embodiments of the invention within the spirit and the scope of the claims.

We claim:

1. In a cryogenic air separation process employing a higher pressure column and a lower pressure column wherein feed air is employed to boil the bottom liquid of the lower pressure column and is thereafter passed into the higher pressure column and wherein liquid oxygen is produced in the lower pressure column, the improvement comprising:

(A) turboexpanding a second portion of feed air to generate refrigeration and passing turboexpanded second feed air into the higher pressure column;

(B) withdrawing liquid oxygen from the lower pressure column and increasing the pressure of the withdrawn liquid oxygen;

(C) vaporizing the pressurized liquid oxygen by indirect heat exchange with a third feed air portion which is at a pressure higher than that of the feed air employed to boil the bottom liquid of the lower pressure column, and also with feed air which is subsequently employed to boil the bottom liquid of the lower pressure column, resulting in the production of oxygen gas;

(D) recovering resulting oxygen gas as elevated pressure oxygen gas product.

2. The process of claim 1 wherein turboexpanded second portion is employed to boil the bottom liquid of the lower pressure column prior to being passed into the higher pressure column.

3. The process of claim 1 wherein feed air from the bottom reboiler is additionally passed into the lower pressure column.

4. The process of claim 1 further comprising producing nitrogen vapor in each of the higher pressure and lower pressure columns and recovering nitrogen vapor as nitrogen gas product from at least one of the higher pressure and lower pressure columns.

5. The process of claim 1 wherein the feed air employed to boil the bottom liquid of the lower pressure column is totally condensed by this heat exchange.

6. The process of claim 1 wherein the feed air employed to boil the bottom liquid of the lower pressure column is partially condensed by this heat exchange.

7. In a cryogenic rectification apparatus having a first column, a second column with a bottom reboiler and means for passing a feed stream to the bottom reboiler and from the bottom reboiler into the first column, the improvement comprising:

(A) a turboexpander, means for passing a second feed stream to the turboexpander and from the turboexpander into the first column;

(B) means for withdrawing liquid from the second column and means for increasing the pressure of the liquid withdrawn from the second column to produce elevated pressure liquid;

(C) a main heat exchanger, means for passing a third feed stream to the main heat exchanger, and means for passing said elevated pressure liquid to the main heat exchanger;

(D) means for passing feed through the main heat exchanger prior to passing it to the bottom reboiler; and (E) means for recovering gas product from the main heat exchanger.

8. The apparatus of claim 7 wherein the means for passing the second feed stream from the turboexpander into the first column includes the bottom reboiler.

9. The apparatus of claim 7 further comprising means for passing feed from the bottom reboiler into the second column.

* * * * *